US005844159A

United States Patent [19]

Posseme et al.

[11] Patent Number: 5,844,159

[45] Date of Patent: Dec. 1, 1998

[54] METHOD AND SYSTEM FOR DESTROYING SUBMERGED OBJECTS, IN PARTICULAR SUBMERGED MINES

[75] Inventors: Gilles Posseme, Brest; Christian Labiau, Plouzane; Gilles Kervern, Plouzane; Guy Le Bihan, Plouzane, all of France

[73] Assignee: Thomson-CSF, Paris, France

[21] Appl. No.: 817,638

[22] PCT Filed: Oct. 13, 1995

[86] PCT No.: PCT/FR95/01352

§ 371 Date: Apr. 28, 1997

§ 102(e) Date: Apr. 28, 1997

[87] PCT Pub. No.: WO96/13426

PCT Pub. Date: May 9, 1996

[30] Foreign Application Priority Data

Oct. 28, 1994 [FR] France ..... 94 12956

[51] Int. Cl.[6] ..... B64D 1/04; F42B 19/01

[52] U.S. Cl. ..... 89/1.13; 114/21.1; 114/21.2

[58] Field of Search ..... 89/1.13, 1.11; 102/402, 403; 114/21.1, 21.2

[56] References Cited

U.S. PATENT DOCUMENTS

| | | | |
|---|---|---|---|
| 3,818,425 | 6/1974 | Peynaud et al. . | |
| 4,104,912 | 8/1978 | Clavelloux et al. . | |
| 4,185,554 | 1/1980 | Anderson et al. | 12/403 |
| 4,316,253 | 2/1982 | Posseme . | |
| 4,470,013 | 9/1984 | Posseme . | |
| 4,653,033 | 3/1987 | Posseme . | |
| 4,731,582 | 3/1988 | Posseme et al. . | |
| 4,774,766 | 10/1988 | Posseme . | |
| 4,808,923 | 2/1989 | Posseme . | |
| 4,972,388 | 11/1990 | Kirkland | 102/402 |
| 4,972,776 | 11/1990 | Shumaker et al. | 102/402 |
| 5,012,717 | 5/1991 | Metersky et al. | 89/1.11 |
| 5,099,746 | 3/1992 | Gustavvson et al. | 89/1.11 |
| 5,646,366 | 7/1997 | O'Connell | 89/1.11 |

FOREIGN PATENT DOCUMENTS

| | | | |
|---|---|---|---|
| 547937 | 12/1992 | European Pat. Off. | 89/1.13 |
| 3626434 | 2/1988 | Germany | 89/1.13 |

OTHER PUBLICATIONS

Schafer, "Minenjagd–Minenjagdboot 331 b", Wehrtechnik, No. 5, pp. 79–81, May 1978.

*Primary Examiner*—Charles Jordan
*Assistant Examiner*—Theresa M. Wesson
*Attorney, Agent, or Firm*—Oblon, Spivak, McClelland, Maier & Neustadt, P.C.

[57] ABSTRACT

The invention consists, after launching (1) a vehicle (9), in guiding (2) the vehicle (9) towards the mine (5; 6) by means of a sonar coupled to a tactical control station (12) of a hunter (8), fulfilling the functions of classification and permanent monitoring of the position of the vehicle (9) relative to the mine (5; 6), in releasing a locating means (13), carried by the vehicle (9), once the vehicle (9) has arrived at a determined distance from the mine (5; 6), making it possible to fulfil a target designation function by interacting with the vehicle (9) and the tactical control station (12) of the hunter (8), then in communicating (3) to the vehicle (9), by means of the tactical control station (12), the navigation parameters necessary for its attack strategy as a function of the type of mines (5; 6) encountered, and its position referenced by the fixed locating means (13), and in destroying (4) the mine (5; 6) according to the attack strategy acquired by the vehicle (9).

11 Claims, 9 Drawing Sheets

METHOD AND SYSTEM FOR DESTROYING SUBMERGED OBJECTS, IN PARTICULAR SUBMERGED MINES

TITLE OF THE INVENTION

BACKGROUND OF THE INVENTION

1. Field of the Invention

The present invention relates to a method, and to a system, for destroying submerged objects, in particular submerged mines, using a submerged consumable autonomous vehicle carrying an underwater destruction device.

The field of the invention relates to mine warfare, a field which confronts all navies.

2. Description of the Related Art

Many of them are equipped with intervention means, sweeping systems and hunting systems, which need to be developed and updated as the mine threat does so —a mine threat against which, still recently, the most modern large-scale naval means have been employed.

The struggle between measures and counter-measures, which is generally in favour of this type of threat, requires the means employed to become more sophisticated and to take more risk, since the threat is becoming ever-more difficult to detect.

In order to meet the operational needs for effectiveness, speed and safety, the intervention techniques and means must be adapted and can no longer be cumbersome manual means. Meeting the threat by direct attack is an idea which has been discussed for several years in those countries which have the greatest role in mine warfare, but has not yet been put into practice successfully.

Among the systems for destroying mines, one known system consists in locating a submerged mine, in releasing a locating means which includes at least two acoustic markers, or transponders, used as fixed references in the vicinity of the mine to be destroyed, in relocating the mine by determining its position relative to these references, and in activating the destruction device by using the positional data. Underwater destruction means are carried by a surface or subsurface craft, optionally controlled remotely from a platform, which tows, for example, a pod equipped with a lateral sonar, this craft being equipped with means for releasing the locating means. A relocating device is, for example, placed at the rear of the pod following in its wake. The destruction device is preferably carried by the relocating device and may, for example, be a torpedo. This mine destruction system has the drawback of employing expensive relocating and destruction means, which may be destroyed at the same time as the mine. Furthermore, this system does not operate effectively in the case of subsurface mines and, in particular, for tethered mines.

SUMMARY OF THE INVENTION

The object of the invention is to overcome the drawbacks mentioned above.

To this end, the subject of the invention is a method for destroying submerged objects, consisting in guiding, from a minehunter vessel, a remotely guided vehicle carrying underwater destruction devices, characterized in that it consists, after launching of the vehicle, in guiding the vehicle towards the mine by means of a sonar coupled to a tactical control station of the hunter, fulfilling the functions of classification and permanent monitoring of the position of the vehicle relative to the mine, in releasing a locating means, carried by the vehicle, once the vehicle has arrived at a determined distance from the mine, making it possible to fulfil a target designation function by interacting with the vehicle and the tactical control station of the hunter, then in communicating to the vehicle, by means of the tactical control station, the navigation parameters necessary for its attack strategy as a function of the type of mines encountered, and its position referenced by the fixed locating means, and in destroying the mine according to the attack strategy acquired by the vehicle.

One of the main advantages of the invention is that it uses a single type of autonomous, remotely guided vehicle, which can be used with full effectiveness and safety for the launch platform, which may be a surface vessel hereafter referred to as the "hunter", this being for bottom mines and for mines with a long or short tether, whether or not they are subsurface mines. Furthermore, the use of an acoustic marker carried by the vehicle makes it possible to fulfil the target designation function in permanent interaction with the high-performance classification means of the hunter, without requiring a high-definition sonar on the vehicle, it being therefore possible for the latter to be consumable.

BRIEF DESCRIPTION OF THE DRAWINGS

Other characteristics and advantages of the invention will emerge more clearly on reading the following description, accompanied by the appended figures, in which, respectively.

DESCRIPTION OF THE PREFERRED EMBODIMENT

Before starting the description of the present invention, it is firstly necessary to define the types of threat to be considered. These threats can be broken down into four categories, each being characterized principally by an individual attack strategy, a charge type and a search procedure.

These four categories are: bottom mine, short-tether mine, long-tether open-water mine and long-tether subsurface mine. The stealth parameter does not arise at this level because the target is assumed to be already detected by the hunter. It is possible that the pyrotechnic nature of the target will not be recognized unless the target has been identified and classified.

A bottom mine is a dense object, of varying shape and volume, which may contain up to one tonne of explosive.

The mine rests on a bed which may be of any type, sandy, rocky, muddy, and its environment may be turbulent water or clear water (having nevertheless allowed it to be detected by the hunting means). The nature of the casing is metallic (steel, aluminium) or composite.

A short-tether mine is a device which has the capacity of delivering an explosive charge by its own means. The mine consists of a fixed assembly, forming a system for anchoring on the bed, and a mobile assembly forming the projectile. These two assemblies are joined using a tether with a length of a few meters.

For long-tether mines, distinction is made between two types of threat: an open-water mine and a subsurface mine. The nature of the target is the same for both types: spherical or cylindrical shaped float having a buoyancy tank in its upper part and an explosive charge in its lower part.

An open-water mine is a mine whose depth is more than 10 m, for which detection is unambiguous, it being possible for the anchor of the tether to be located at any submersion depth.

A subsurface mine is a target whose depth is less than 10 m, for which detection may be made difficult because of the proximity of the surface, which may make the approach difficult depending on the sea conditions. It is important to define each type of target correctly, because it is according to the types of target detected that a particular attack strategy is adopted by the destroyer vehicle.

Figure 1:
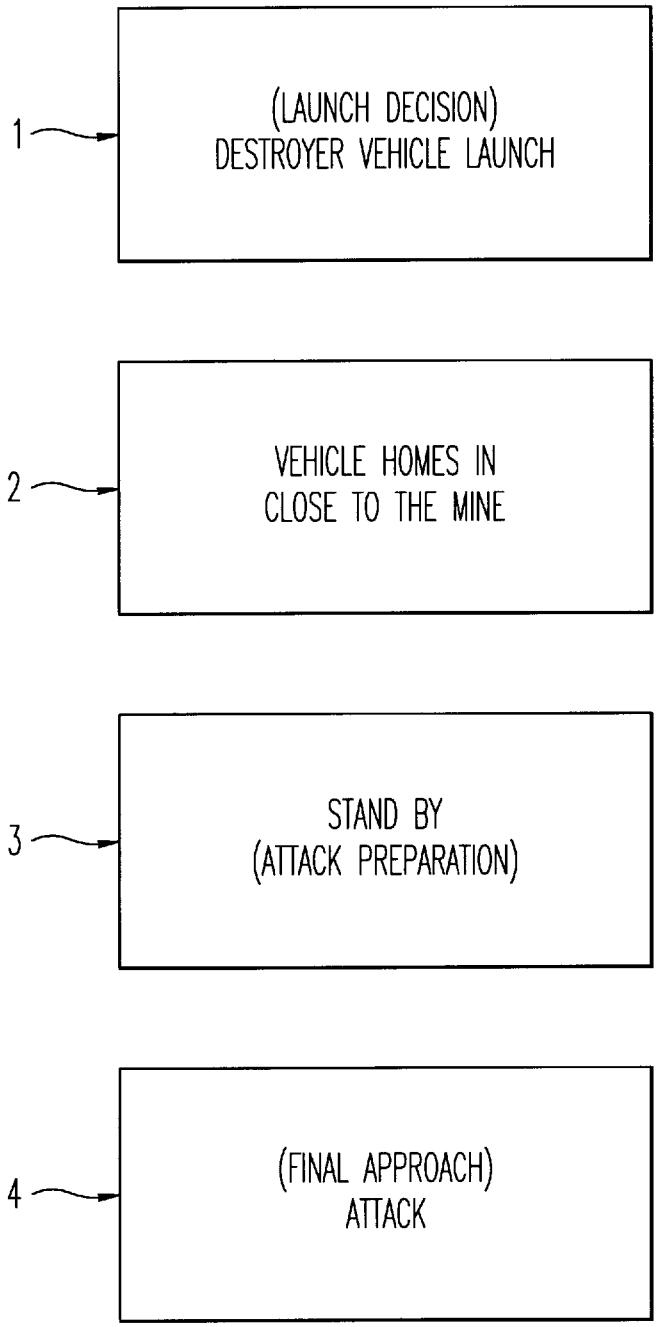
FIG. 1 represents a block diagram of the main sequences in the method according to the invention.

The method according to the invention is described below according to two main scenarios, depending on whether the mine is a bottom mine or a tethered mine. Each of these two scenarios breaks down into four identical main sequences 1 to 4 illustrated by FIG. 1: a sequence 1 of launching the destroyer vehicle, a sequence 2 of the vehicle homing in close to the mine, a standby sequence 3 and an attack sequence 4.

Figure 2A:
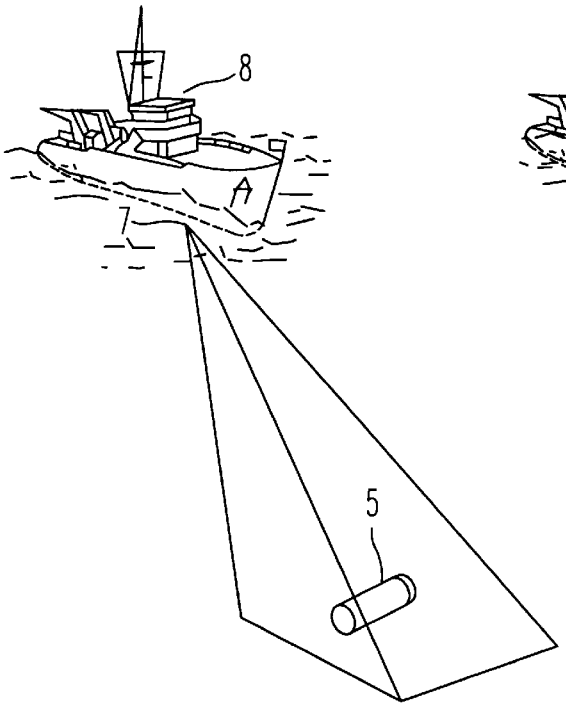
FIGS. 2*a* and 2*b* represent the step prior to the launch sequence.
Figure 2B:
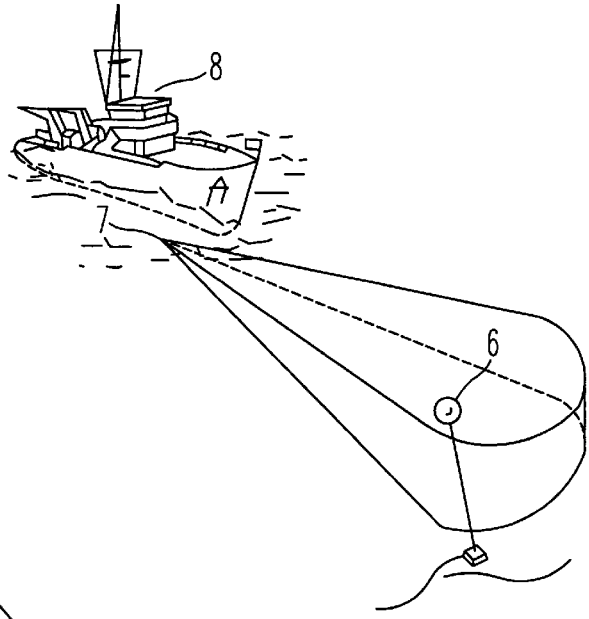

A step prior to the launch sequence 1, illustrated by FIGS. 2*a* and 2*b,* makes it possible to take a launch decision after detection, classification and possibly identification of a mine, which mine is laid on the bed 5 (FIG. 2*a*) or is a subsurface mine 6 (FIG. 2*b*), in particular a tethered mine. This launch decision is taken by hunting means 7 located, for example, in a hunter 8. At this stage, the coordinates of the mine 5, 6 are known to the hunter 8, as is the nature of the threat and certain environmental data. All these operations and data acquisitions are performed by the hunting means 7 on board the hunter 8. In order to accomplish its destruction mission, the hunter 8 remains in the status for classification of the mine 5, 6 for as long as possible during the mission.

Figure 3:
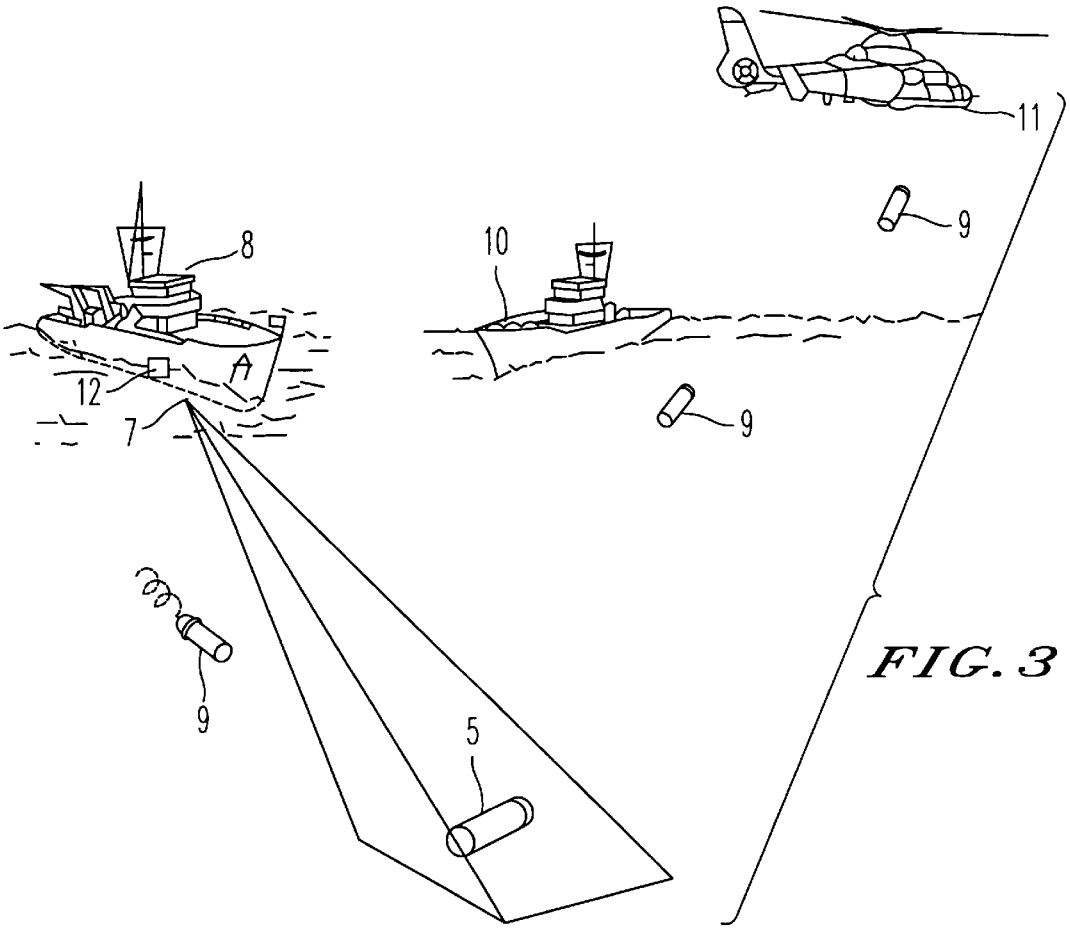
FIG. 3 represents three types of launch platform.

Once the decision has been taken, a destroyer vehicle 9 is launched from a platform. FIG. 3 illustrates the various types of launch platforms, it being possible for this platform to be the hunter 8 itself, a specialized surface vessel 10, or a helicopter 11.

In order to ensure that the hunter 8 is safe throughout its mission, it is necessary to know the position of the destroyer vehicle 9 at any time between the launch sequence 1 and the end of the mission, that is to say the attack sequence 4, and the vehicle 9 must therefore be tracked. The imager of the hunter 8 (not shown) cannot be used because it must remain aimed at the mine 5, 6. Since it is not omnidirectional, a device specific to guiding the destroyer vehicle 9 is necessary.

In order to benefit from high accuracy in the relative position of the hunter 8 relative to the mine 5, 6, the guiding is performed from the hunter 8. To this end, the functions of guiding, tracking, and more generally communication between the destroyer vehicle 9 and the hunter 8 are implemented by a specific device, referred to hereafter as the "tactical control station" 12, coupled to the hunting means 7, which will together be denoted hereafter by the single term tactical control station 12.

The tactical control station 12 takes control of the destroyer vehicle 9 as soon as it enters the water. It manages the mission of the destroyer vehicle 9 automatically until it is completed. The operator intervenes only to give the attack order although, via the tactical control station 12, he is provided with operational information regarding the progress of the mission. Located on board the hunter 8, the tactical control station 12 benefits from all the information of the hunting means 7: the (relative, classification) coordinates of the target, the environmental data (bed, current, profile, bathometry) as well as all the data relating to the mine with respect to its environment, which may contribute to the success of the mission (configuration of the bed, results of the identification, etc.).

The tactical control station 12 guides and tracks the destroyer vehicle 9 from the launch sequence 1 to the standby sequence 3. It communicates its mission parameters to it, and in return receives a coded message, or "status", from the destroyer vehicle 9, the message containing its depth and its condition data. During the attack sequence 4, although it is autonomous, the vehicle 9 is still tracked, subject to the acoustic propagation conditions of the surroundings. From the hardware point of view, the tactical control station 12 is, for example, equipped with a transmission/reception base with two acoustic transducers 12A having hemispherical directionality at a range of about 1 km. The base is mounted on the hull of the hunter 8, so as to measure the apparent bearing of the destroyer vehicle 9. This base is not represented.

Under these conditions, the sequence 2 of the vehicle 9 homing in on the target 5, 6 can take place with the accuracy of the classification function of the sonar. Distinction must hereafter be made between the final approach and the attack. The final approach, after the homing sequence 2, requires accurate knowledge of the objective, through learning by the autonomous vehicle 9, or assisted by the tactical control station 12 of the hunter 8, until the vehicle 9 has all the data allowing it to attack the target 5, 6 in sequence 4. The attack should lead to the destruction of the target 5, 6, which entails that all provisions be made so that the operational means located on board the hunter 8 are in a safe situation. In order to allow the hunter 8 to depart from the destruction zone of the mine 5, 6, a standby sequence 3 is necessary and corresponds to a preparatory sequence preceding the attack sequence 4.

The definition of the coordinates of a bottom mine 5 is better than that of the coordinates of a tethered mine 6. Conversely, detection close to a tethered mine 6 is unambiguous. These are two different problems for which the same result is sought - a direct hit using a single consumable vehicle.

The two scenarios, bottom mine scenario and tethered mine scenario, are detailed below for the various sequences 1 to 4 of the mission, some of which are common to both scenarios.

As already described above, the hunter 8 is, for example, a surface vessel including an imager and a high-definition classifier sonar, both coupled to a tactical control station 12 which generally makes it possible to communicate with the autonomous destroyer vehicle 9 throughout the mission. The hunter 8 has firstly located a target. After classification of the target using the sonar of the hunter 8, an attack strategy is chosen by the tactical control station 12 in accordance with the type of mine detected: bottom mine, long-tether mine., short-tether mine, or subsurface mine. To this end, the tactical control station 12 acquires various parameters before launch 1 of the destroyer vehicle 9. These parameters define the nature of the threat, the coordinates of the mine, the water depth, the direction and strength of the average current, the altitude in the case of a bottom mine or a short-tether mine, or the depth in the case of a subsurface mine or a long-tether mine.

During the sequence 1 of launching the destroyer vehicle 9, the latter is electrically inert so long as it has not reached a determined safety depth. By default, the destroyer vehicle 9 adopts a number of parameters. It does not yet know the objective of its mission. The tactical control station 12 guides the destroyer vehicle 9 towards the mine 5, 6.

Figure 4:
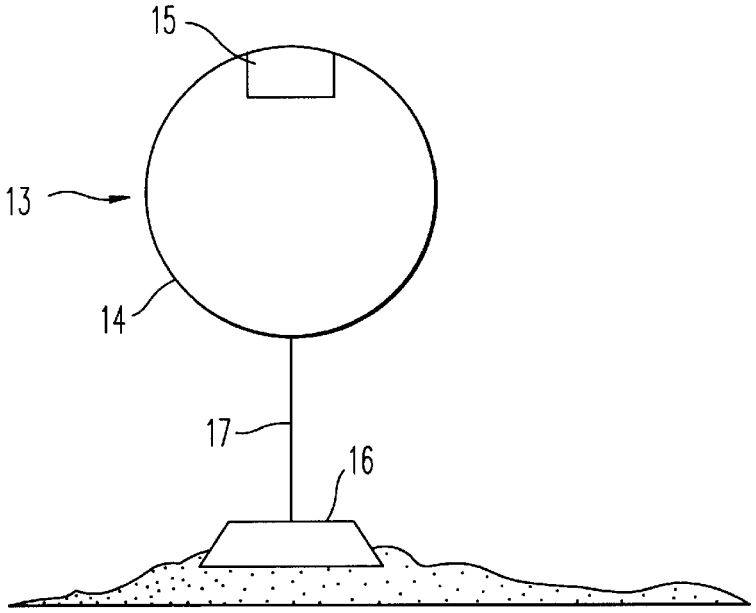
FIG. 4 represents an acoustic marker of a system according to the invention for destroying submerged mines.

According to the invention, the destroyer vehicle 9 carries a locating means 13 which will be released in the vicinity of the mine 5, at a determined distance therefrom. The locating means illustrated in FIG. 4 constitutes an acoustic marker.

The marker 13 consists of a part with positive buoyancy, for example a spherically shaped float 14 with an overall diameter of the order of 10 cm. Positioned a few centimeters from the bed, the float 14 ensures good contrast. In the case of a bottom mine 5, the marker preferably transmits and can be heard in the entire upper hemisphere but only at a short range. In the case of a tethered mine 5, the marker 13 preferably transmits and can be heard over an angle of approximately $3\pi/2$ radians, but over a longer distance such as approximately 400 meters.

In order to define a reference vertical, a transmission transducer 15 is arranged on the top of the float 14. Since one of the essential functions of the marker 13 is to be fixed on the bed in order to give the "bed" reference, the marker 13 is therefore equipped with a dense anchor 16, of arbitrary shape, which accommodates the initiatable battery and the transmission electronics, hereafter referred to as the "transmitter". The float 14, fitted with the transducer 15, is coupled to the anchor 16 by a tether 17 serving as a conductor between the transmitter 16 and the transducer 14. If a propulsion and/or power supply malfunction occurs in the destroyer vehicle 9 during the homing sequence 2 it falls to the bed.

The marker 13 has two main functions: the first, relay function for target designation, and a second, "pinger" function for locating the destroyer vehicle 9 in the event of malfunctions during the homing sequence 2.

The marker 13 is fixed on the destroyer vehicle 9 during the launch 1 and homing 2 sequences before being released, for example by remote control, at the end of the sequence 2 of homing in close to the mine 5. The marker 13 is autonomous and is, for example, supplied by a battery which can be initiated by sea water.

When the marker 13 is released, it must fulfil three functions:

- it must be seen by the hunter 8, in the case of a bottom mine 5,
- it must be heard by the destroyer vehicle 9; and
- it must be fixed on the bed, in order to represent a fixed "bed" reference for the vehicle 9.

Since the release decision is intentional, the marker 13 lies in the field irradiated by the sonar of the hunter, in a zone which is known with small uncertainty. Accordingly, a modest reflection index of the order of −20 dB is sufficient to be seen by the classifier sonar of the hunter 8.

Figure 5:
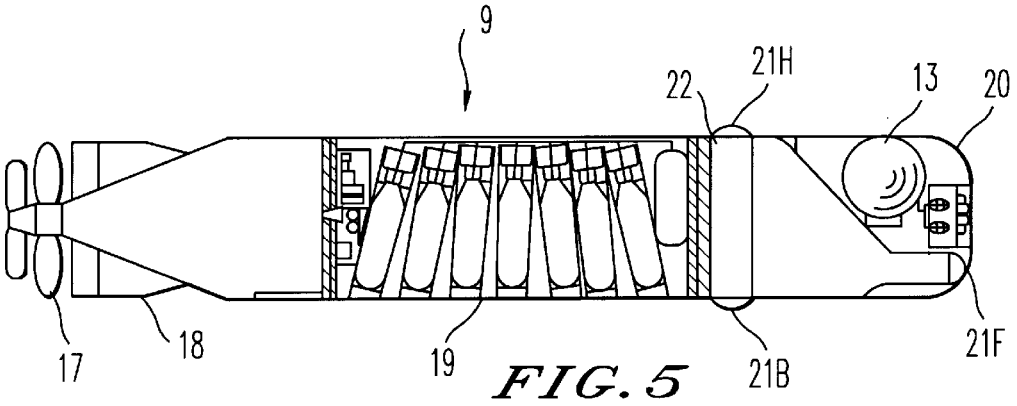
FIGS. 5 and 6 represent a destroyer vehicle of a system according to the invention for destroying submerged mines.
Figure 6:
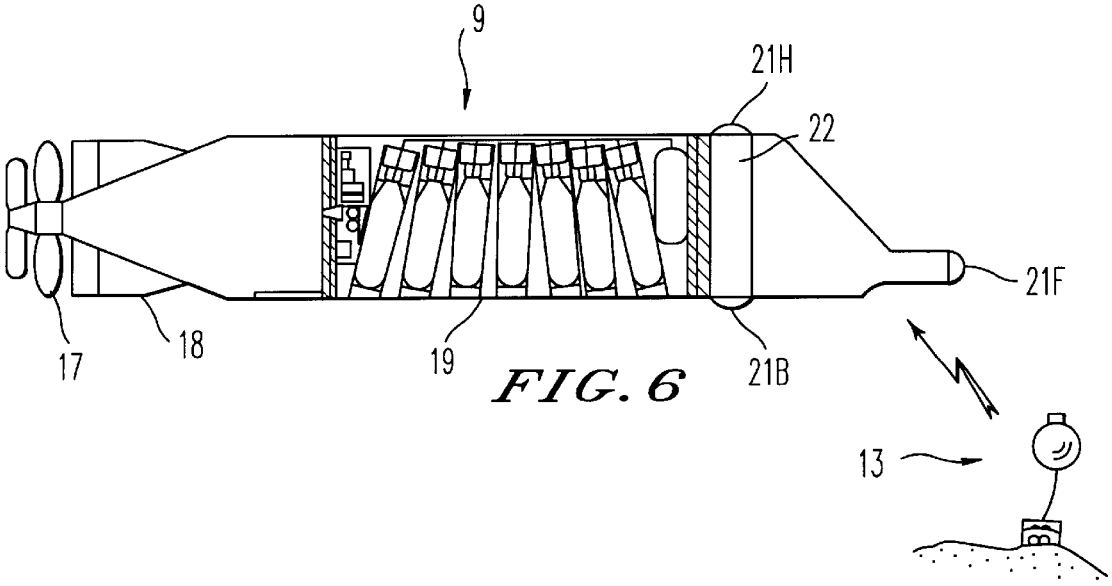

An example of a destroyer vehicle 9 is represented by FIGS. 5 and 6.

FIG. 5 represents the vehicle 9 at the start of the mission, during the launch sequence 1 and the start of the homing sequence 2.

FIG. 6 represents the vehicle at the end of the homing sequence 2, with the marker 13 having been released. In these two figures, the elements which are similar are denoted by the same references.

The vehicle 9 includes propulsion 17 and rudder device 18 which are located in the tail of the vehicle 9, a submarine munitions compartment 19 which is located at the centre of the vehicle 9, the marker 13 and its ejection device 20, which is arranged in the head of the vehicle 9, a set of homers 21H, 21B and 21F and sensors (not shown) coupled to control electronics 22.

A homer is an assembly of transmission and reception acoustic transducers. Its role is divided into three main functions:

- a function as a vertical and/or front sounder;
- a function of detecting and locating the marker 13, and
- a function of detecting and locating a tethered mine 6.

The vertical sounder function generates transmission downwards or upwards relative to the destroyer vehicle, and operates by detecting the first echo.

There is no need to perform directional transmission/reception, since the zone close to the target is not unknown because it has been read by the imager of the hunter 8, and the homing is guided. The range of the sounder is about 50 m.

The destroyer vehicle 9 thus has external references (marker 13, mine 6) and internal means intended to accomplish its mission.

It has a first external reference relating to the bed (the marker 13), and a second external reference to be recognized (the mine 6). The internal means should allow it to be positioned in absolute terms with respect to these references at any time during its mission. These internal means are therefore composed:

- of three homers, vertical homers 21H and 21B, respectively arranged on the vehicle 9 in order to cover the upper and lower hemispheres of the vehicle 9, and the front homer, arranged at the head of the vehicle 9 and of the set of sensors distributed over the vehicle 9, altitude sensors, transmission sensors, attitude sensors (heading, roll, pitch), as well as means indicating the speed of the vehicle 9 relative to the water, and computation means.

The computation means fitted on board the vehicle 9 allow it to calculate, on the basis of its guide commands, its depth (or altitude) its heading and its speed, which will then be translated by the vehicle 9 into commands for the rudder 18 and propulsion 17 elements.

During the homing sequence 2 the marker 13 is active and its transmission is used by at least one of the homers of the vehicle 9 to synchronize its internal clock by acoustic coupling, which obviates implementation of a reception function on the marker 13.

When the vehicle 9 is being guided towards the mine 5, the tactical control station 12 measures the oblique distance of the destroyer vehicle 9 and its apparent bearing. The destroyer vehicle 9 then transmits its depth and its "status" to the tactical control station 12. The tactical control station 12 then calculates the coordinates of the destroyer vehicle 9, and then transmits them to the vehicle 9 together with the guide data and the nature of the threat, which induces a determined strategy and default parameters, information regarding the current, as well as other specific parameters. The tactical control station 12 then transmits the command for ejecting the marker 13 from the vehicle 9.

In the case of a bottom mine 5, after the marker 13 has been released in proximity to the mine 5, in the standby sequence 3, the destroyer vehicle 9 is positioned at an altitude corresponding to the altitude of a determined standby orbit. During this time, the tactical control station 12 transmits a setpoint attitude to the destroyer vehicle 9, which is positioned on a standby orbit around the marker 13. During the standby sequence 3, the destroyer vehicle 9 "learns" the direction of the current, and the tactical control station 12 transmits to it the coordinates of a vector $\overline{CM}$ measured by the classifier sonar of the hunter 8, this vector $\overline{CM}$ giving the position of the mine 5 relative to the fixed reference constituted by the acoustic marker 13 which continuously transmits a signal that can be recognized by the vehicle 9. The vehicle 9 then leaves its standby orbit and is positioned in orbit around the mine 5, it calculates the trajectory which allows it to arrive on the mine 5, facing the current, then transmits a "status" to the tactical control station 12. Throughout the homing 2 and standby sequence 3, the vehicle 9 and the mine 5 are seen in the classifier field of the hunter 8. At the end of the sequence 3, the destroyer vehicle 9 is then fully autonomous, and the hunter 8 departs to a determined safety distance from the destruction zone. The vehicle 9 then reaches an attack altitude and embarks on a trajectory according to the trajectory calculated from the data which are continuously updated by the tactical control station 12 of the hunter 8, these data corresponding to the data relating to azimuth, distance of the mine 5 from the marker 13, i.e. the vector $\overline{CM}$ and altitude. In the attack sequence 4, the vehicle 9, fires "in motion", along the vertical of the target 5.

In the case of a subsurface mine 6 whose depth is less than 10 m, after the marker 13 has been released, the vehicle 9 is guided into the proximity of the mine 6, at a default standby orbit depth.

In the "tethered mine" scenario, on reception of a command originating from the hunter 8, the homer 21H covering the upper hemisphere of the vehicle 9 is triggered. It manages the reception of the information output by the marker 13, as well as the transmission of its homer 21H.

Since the marker 13 and the vehicle 9 are synchronized, the function of detecting and locating the marker 13 does not employ any of the reception transducers, which are the same as the transducers of the sounder which no longer needs to be operational because location of the marker 13 implicitly fulfils the sounder function. The vehicle 9 measures the coordinates of the marker 13 by remote localization; the range of the marker 13 is of the order of 400 m.

In the function of detecting and locating a tethered mine 6, the vehicle 9 is guided by the tactical control station 12 of the hunter 8 and runs at a lower altitude than the tethered mine 6 (subsurface or open-water). The transmission of the homer 21H covers the upper hemisphere of the vehicle over an angle of about 120°. The vehicle 9 is thus provided with the coordinates of the mine 6 relative to itself.

In the case of a short-tether mine, operation is symmetrical, the second, vertical homer 21B generating transmission/reception downwards to cover the lower hemisphere of the vehicle over an angle of about 120°. It is the front homer 21F of the vehicle 9 which allows it to re-acquire and pursue the mine 6 when the vehicle 9 leaves its standby orbit to be positioned at the depth of the mine 6. The bearing aperture of the front homer 21F is wide enough to cover the uncertainty relating to the position of the mine relative to the marker 13. The azimuthal aperture is restricted so as to reduce the surface echo in the case of a subsurface mine. The, range of the homers is of the order of 50 m.

The following FIGS. 7 to 23 schematically illustrate the various steps in the method according to the invention, according to the two scenarios. For these various figures, those elements which are similar are denoted by the same references.

Figure 7:
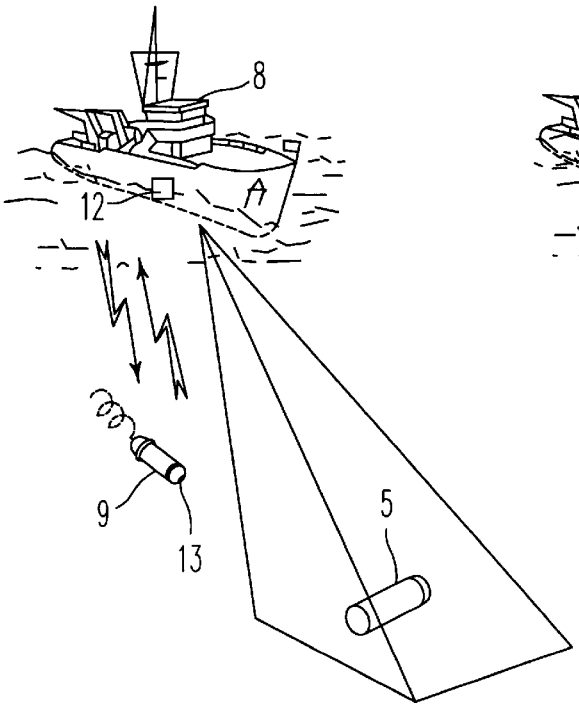
FIGS. 7 to 24 represent the various steps according to the invention according to two scenarios, bottom mine and tethered mine.
Figure 8:
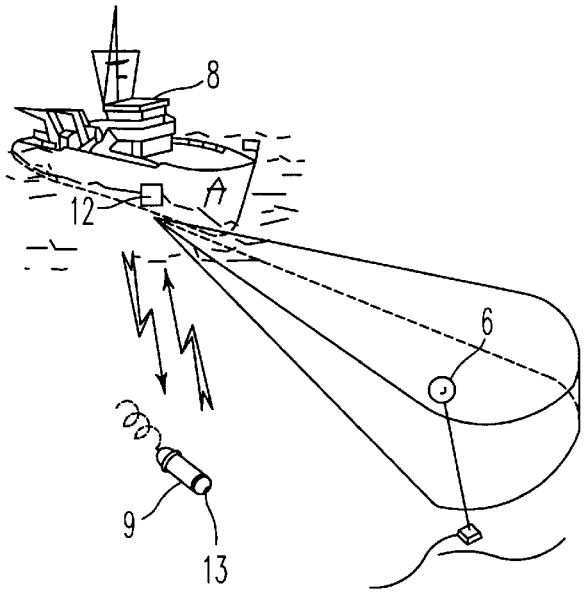

FIGS. 7 and 8 illustrate the guidance towards the mine, respectively for a bottom mine 5 and for a tethered mine 6. The tactical control station 12 of the hunter 8 guides the destroyer vehicle 9. The marker 13 is powered by an initiatable battery. The destroyer vehicle 9 and the marker 13 which it carries are synchronized by acoustic coupling. The attitude, altitude and heading sensors are activated.

The tactical control station 12 measures the oblique distance of the destroyer vehicle 9 and its apparent bearing. The destroyer vehicle 9 then transmits its depth and its status to the tactical control station 12. The tactical control station 12 then calculates the coordinates of the destroyer vehicle 9. It then transmits to the destroyer vehicle 9:

the guide data, the nature of the threat, which induces a strategy and default parameters, and the command to eject the marker 13, as well as specific parameters etc.

Figure 9:
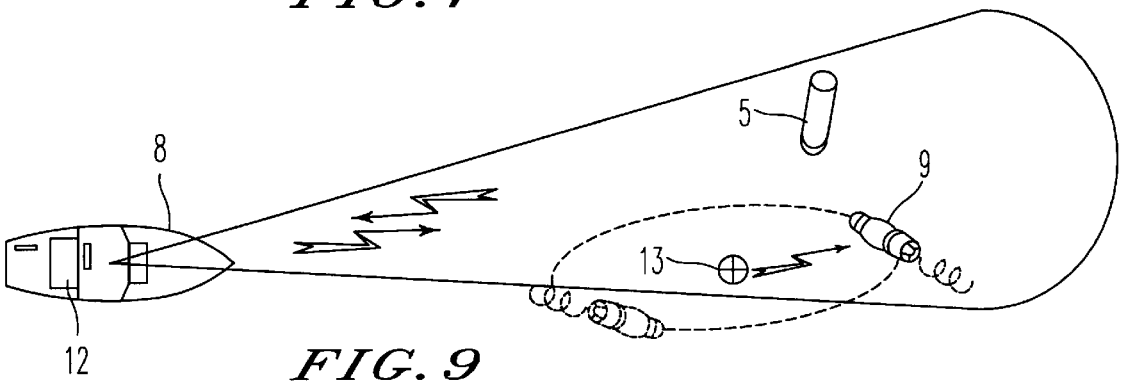
Figure 10:
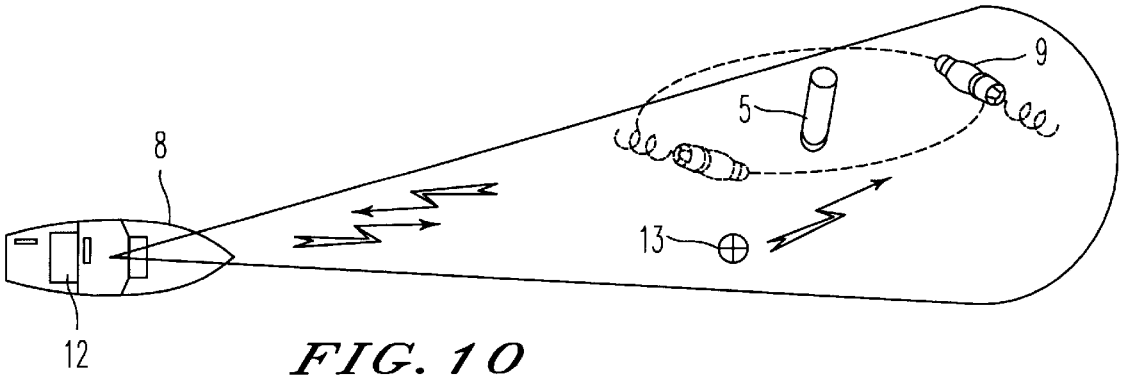
Figure 11:
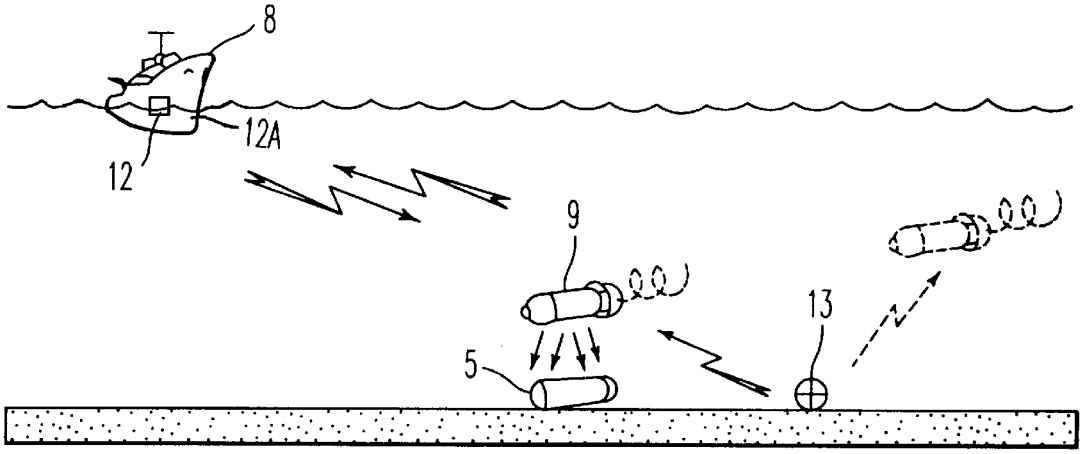

The following FIGS. 9 to 11 relate more particularly to the "bottom mine" scenario.

FIG. 9: After release of the marker 13 in proximity to the mine 5, the destroyer vehicle 9 is positioned at the default standby orbit altitude. The tactical control station 12 optionally transmits a set point altitude to the destroyer vehicle 9, which is positioned on an orbit around the marker 13 in the forward direction, remotely controlled, and is autonomous. During this time, the destroyer vehicle 9 learns the direction of the current.

FIG. 10: The tactical control station 12 transmits the characteristics of the vector $\overline{CM}$ measured by the classifier sonar of the hunter 8. The destroyer vehicle 9 is positioned in orbit around the mine 5 and calculates the trajectory which allows it to arrive on the mine 5 facing the current, then transmits a status to the hunter 8. The marker 13 and the mine 5 are seen in the classifier field of the hunter 8. The destroyer vehicle 9 is autonomous and the hunter 8 withdraws to a safety distance.

FIG. 11: The tactical control station 12 of the hunter 8 transmits the attack command to the destroyer vehicle 9. The destroyer vehicle 9 leaves its orbit to resume its attack altitude, then attacks along the trajectory calculated and updated by the data relating to azimuth, marker distance, $\overline{CM}$ vector and altitude. The destroyer vehicle 9 then fires, "in motion", along the vertical of the mine 5.

The following FIGS. 12 to 24 relate to the "tethered mine" scenario.

FIGS. 12 to 17 more particularly illustrate the case of a subsurface mine, that is to say one whose depth is less than 10 m.

Figure 12:
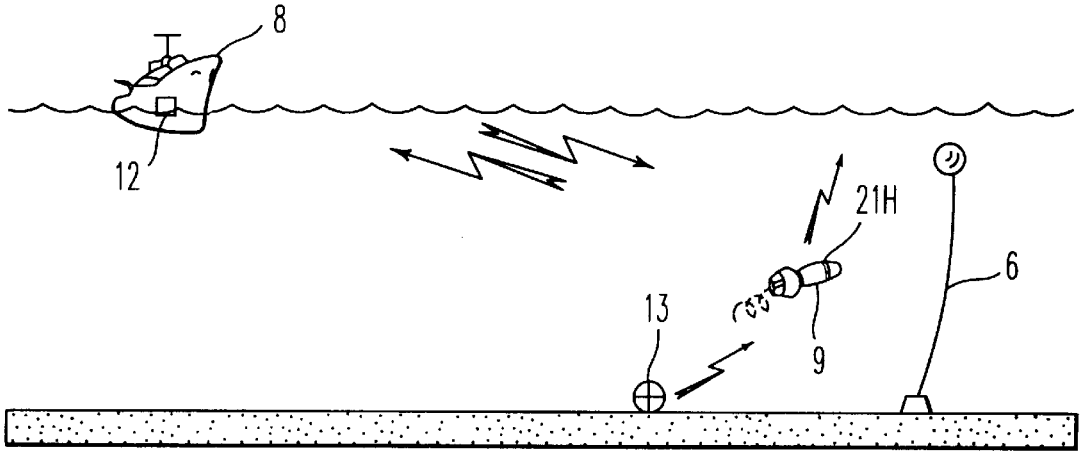

FIG. 12: After release of the marker 13, the destroyer vehicle 9 is guided into proximity of the mine 6, at the default standby orbit depth. The homer 21H of the vehicle 9 is triggered over the upper hemisphere. The destroyer vehicle 9 manages the reception of the signals transmitted by the marker 13, as well as the transmission of its homer 21H.

Figure 13:
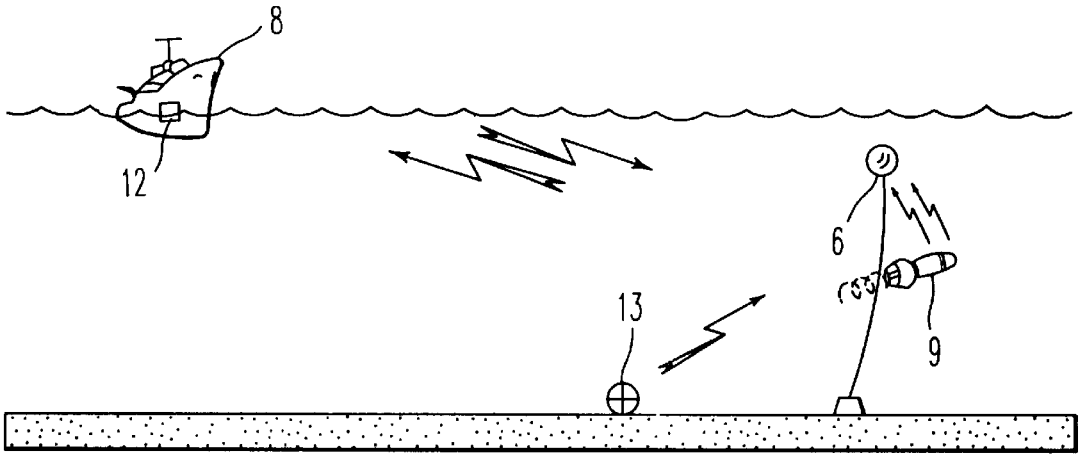

FIG. 13: The guided destroyer vehicle 9 runs at constant depth, and measures and learns:

the depth of the mine 6, the geometry by the vector $\overline{CM}$ and the direction of the current.

The destroyer vehicle 9 transmits the depth of the mine 6 and a status to the tactical control station 12.

Figure 14:
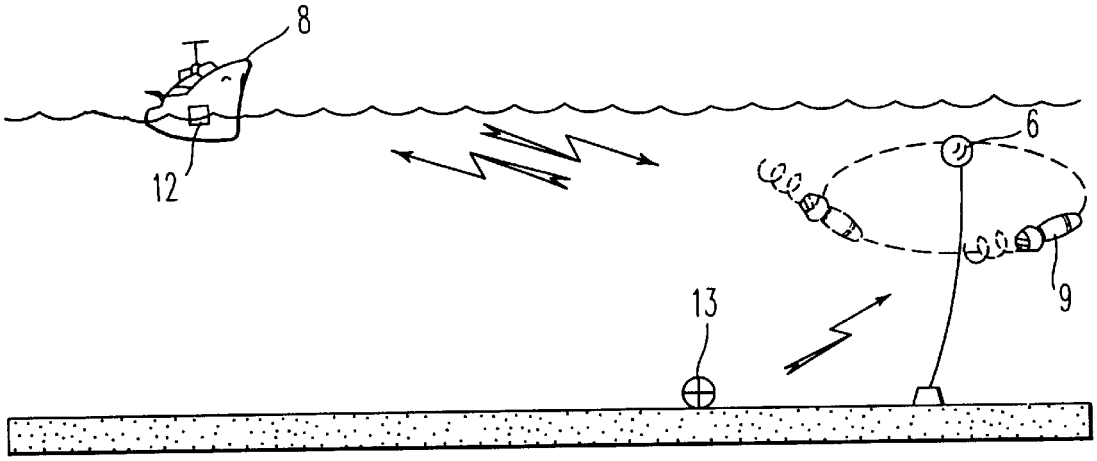

FIG. 14: The tactical control station 12 transmits to the destroyer vehicle 9 the command for entering orbit around the mine 6, and optionally the depth; the orbit is referenced with respect to the marker 13. The destroyer vehicle 9 calculates the trajectory which allows it to arrive on the mine 6 facing the current. The tactical control station 12 observes that orbit is entered. The destroyer vehicle 9 is autonomous and the hunter 8 withdraws to safe distance.

Figure 15:
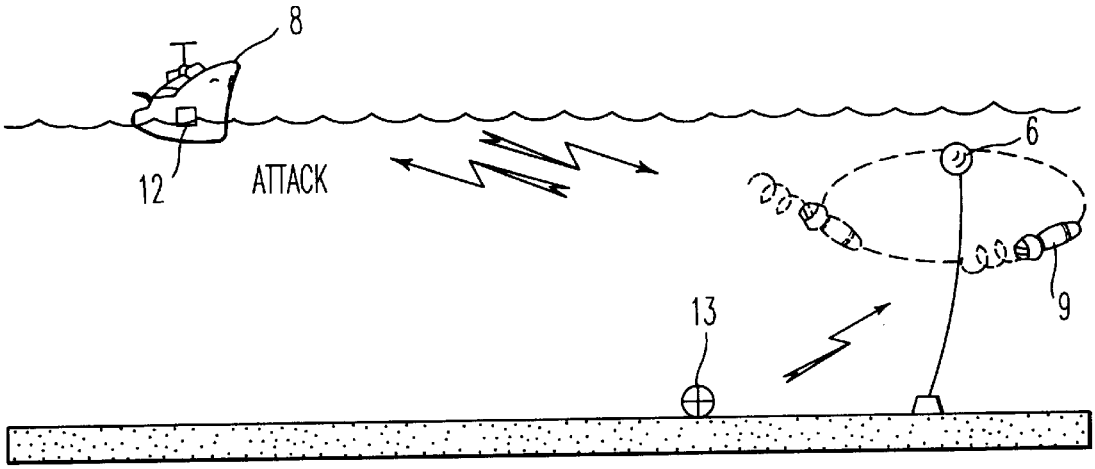

FIG. 15: Once the hunter 8 is at a determined safety distance, the tactical control station 12 transmits the attack command to the destroyer vehicle 9.

Figure 16:
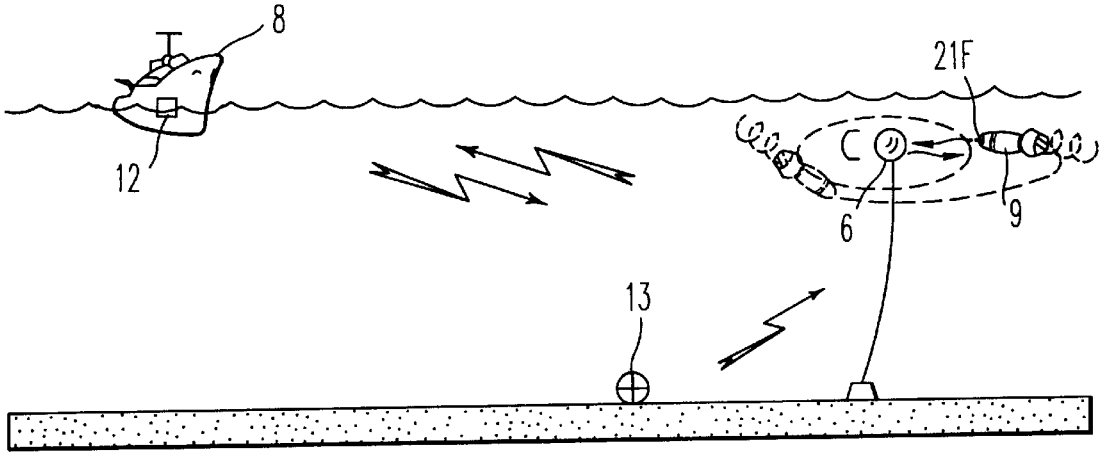

FIG. 16: The destroyer vehicle 9 resumes its attack depth, corresponding to that of the mine 6, along the calculated trajectory bringing it to face the current. The destroyer vehicle 9, oriented by means of the marker 13, re-acquires the mine 6 using its front homer 21F.

Figure 17:
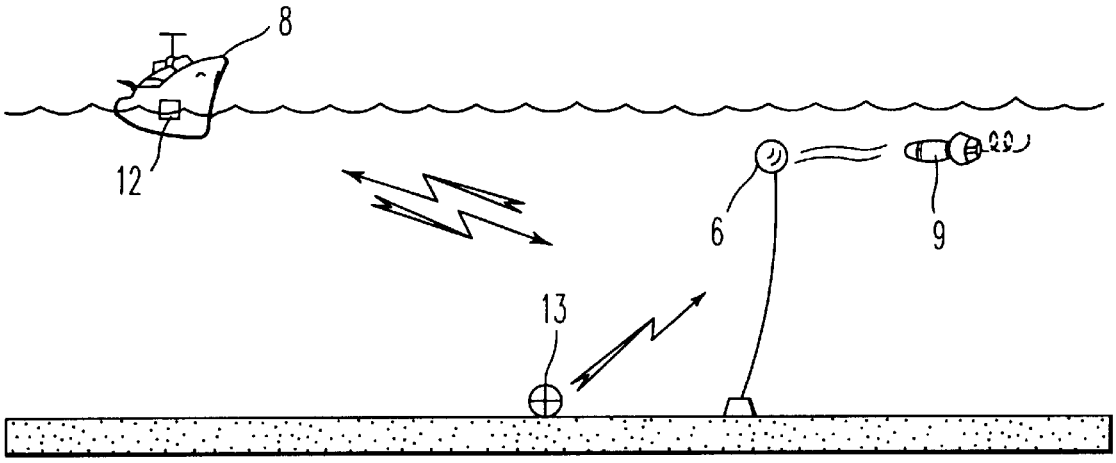

FIG. 17: The destroyer vehicle 9 has acquired the mine 6 using its front homer 21F. It updates its final trajectory to pass across the mine 6, facing the current, then it fires in motion onto the side of the mine 6.

The following FIGS. 8 to 23 more particularly illustrate the case of a short-tether mine.

Figure 18:
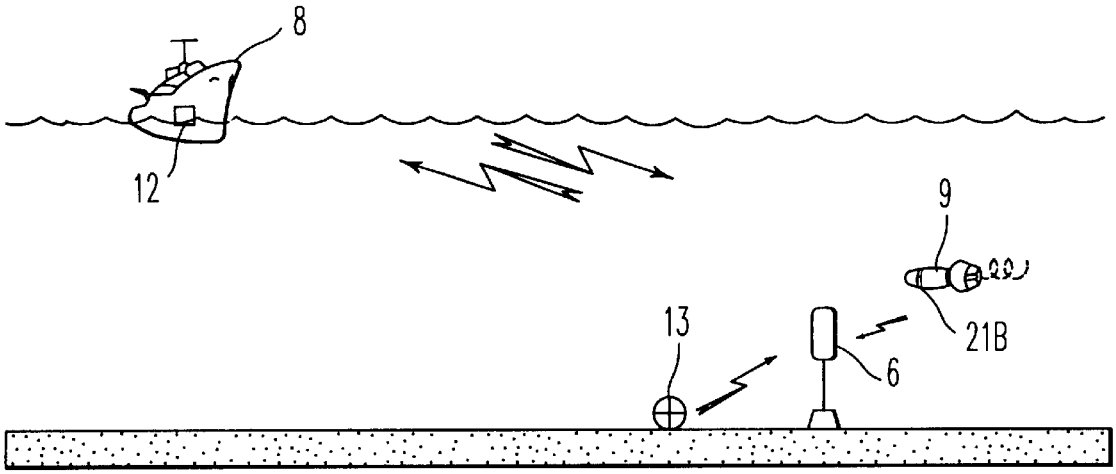

FIG. 18: After release of the marker 13, the destroyer vehicle 9 is guided into proximity of the mine, at the default standby orbit altitude, for example 12 m above the bed. The vertical homer 21B, covering the lower hemisphere, is triggered. The destroyer vehicle 9 manages the reception of the signals transmitted by the marker 13, as well as the transmission of its homer 21B.

Figure 19:
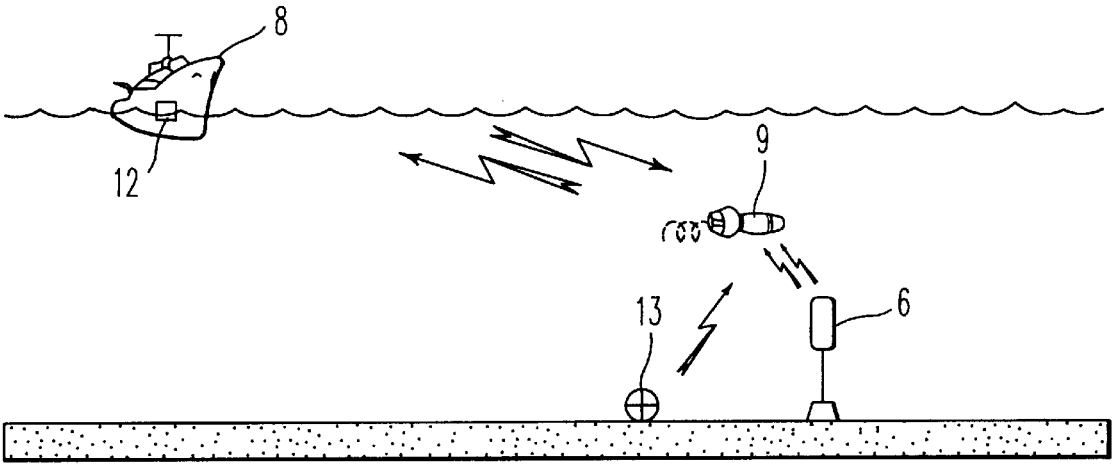

FIG. 19: The guided destroyer vehicle 9 runs at constant altitude, and measures and learns.

the altitude of the mine 6, the geometry by its vector $\overline{CM}$, and the direction of the current.

It then transmits the altitude of the mine 6 and a "status" to the tactical control station 12.

Figure 20:
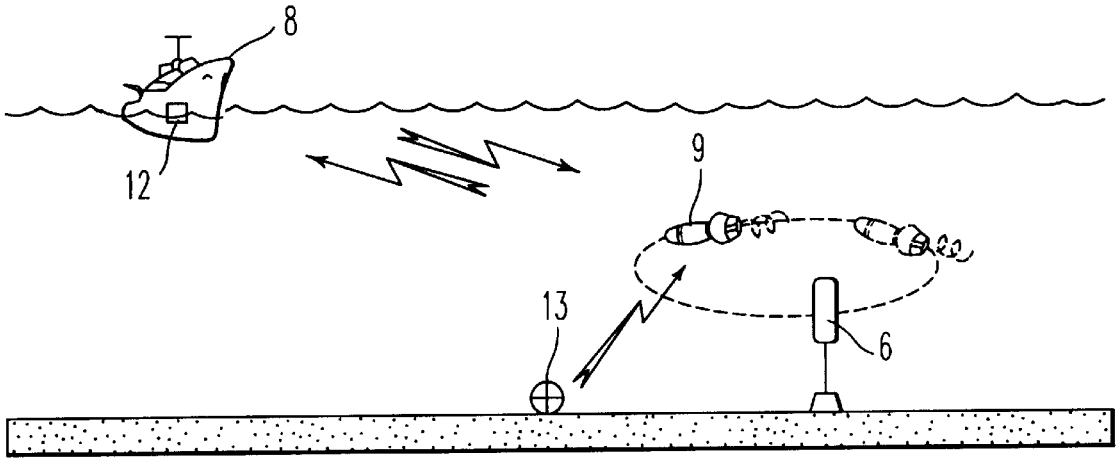

FIG. 20: The tactical control station 12 transmits to the destroyer vehicle 9 the command for entering orbit around the mine 6, and optionally the depth; the orbit is referenced with respect to the marker 13. The destroyer vehicle 9 calculates the trajectory which allows it to arrive on the mine 6, facing the current. The tactical control station 12 observes that orbit has been entered. The destroyer vehicle 9 is autonomous and the hunter 8 withdraws to safe distance.

Figure 21:
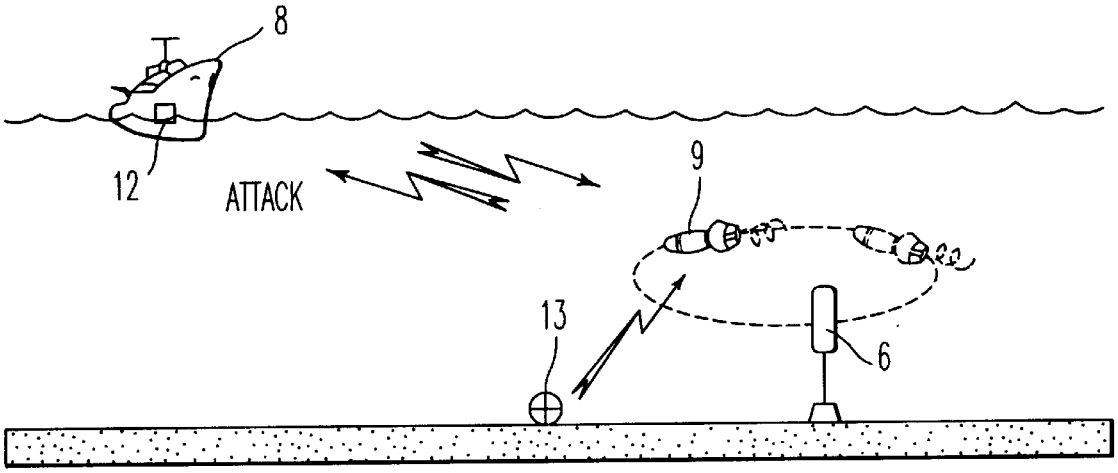

FIG. 21: The hunter 8, at a safe distance, transmits the attack command using the tactical control station 12.

Figure 22:
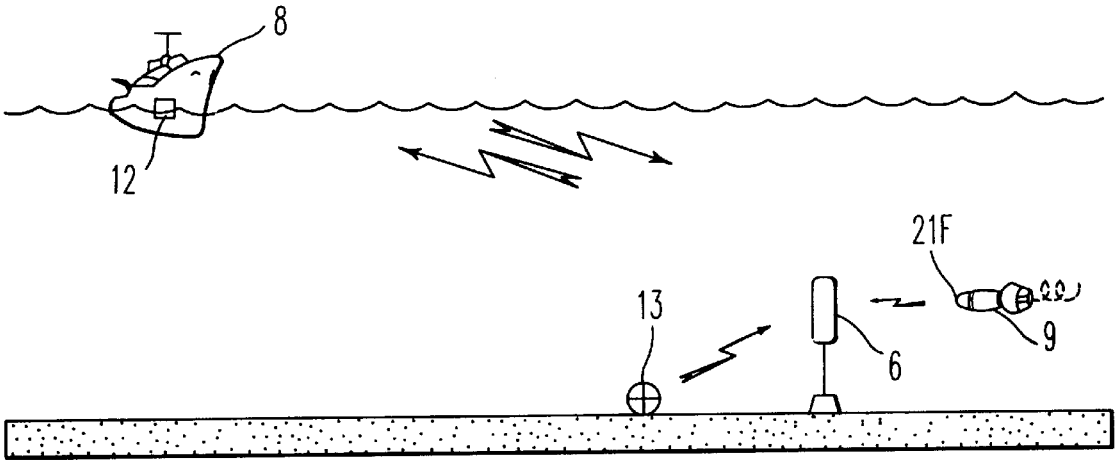

FIG. 22: The destroyer vehicle 9 resumes its default attack altitude (about 2 m below the uppermost point of the mine 6), along the calculated trajectory bringing it to face the current. The destroyer vehicle 9, being oriented using the marker 13, re-acquires the mine 6 using its front homer 21F.

Figure 23:
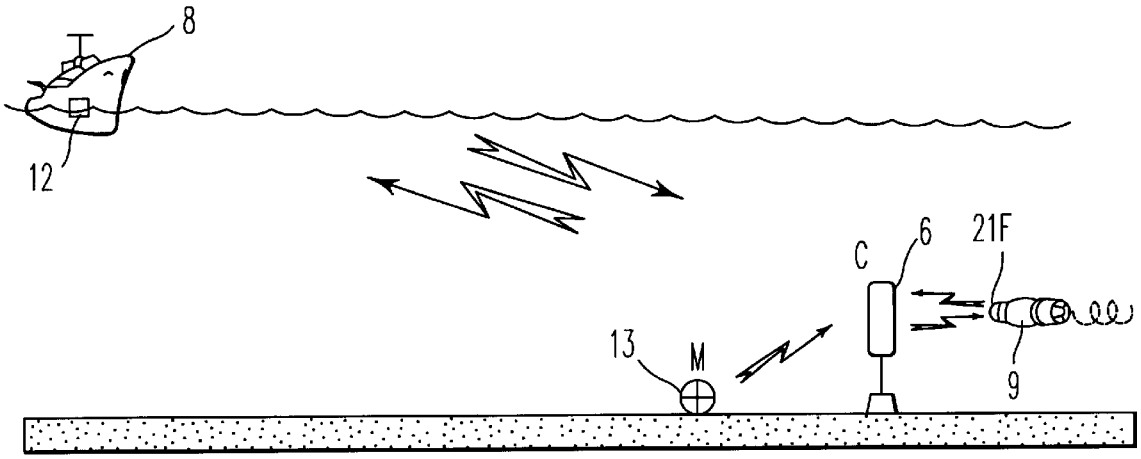

FIG. 23: The destroyer vehicle 9 has acquired the mine 6 using its front homer 21F. It updates its final trajectory to pass across the mine 6, facing the current, then fires "in motion" onto the side of the mine 6.

Figure 24:
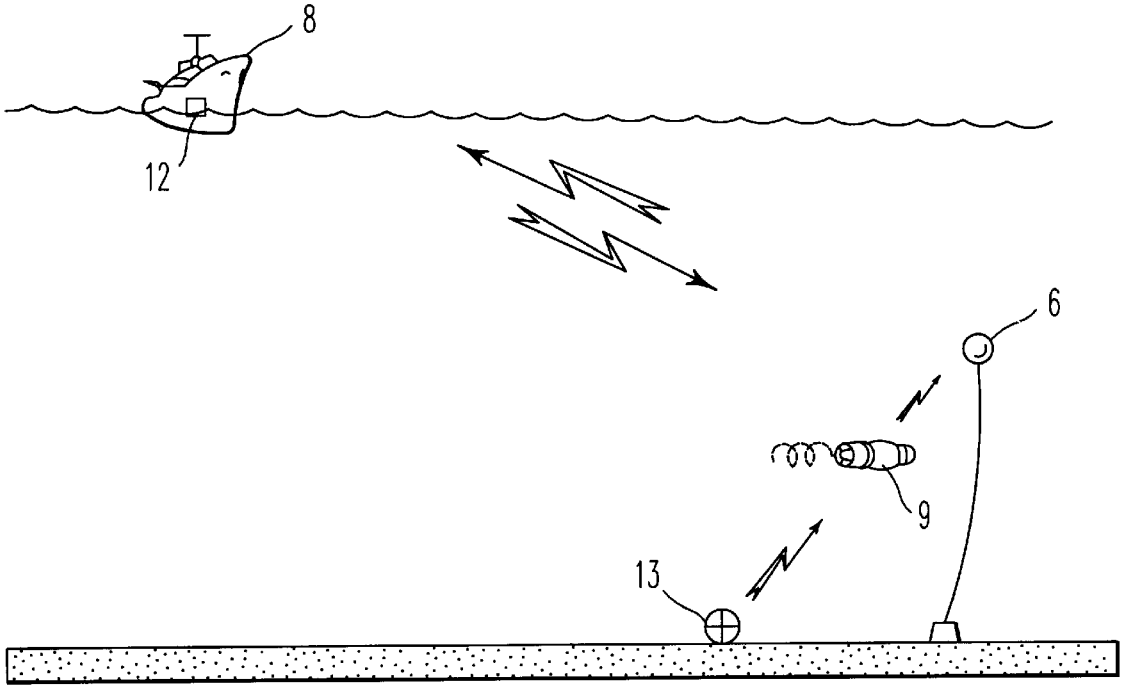

FIG. 24 illustrates the case of a long-tether mine 6, that is to say one whose depth is more than 10 m. Since the attack strategy is the same as the one adopted for the subsurface mine, it is therefore not described again.

We claim:

1. Method for destroying submerged objects, comprising the steps of:

guiding a remotely guided vehicle after launching towards a mine by means of a sonar coupled to a tactical control station of a hunter;

classifying the mine and monitoring the position of the vehicle relative to the mine;

releasing a locating means, carried by the vehicle, once the vehicle has arrived at a determined distance from the mine;

communicating to the vehicle, by means of the tactical control station, the navigation parameters necessary for the vehicle's attack strategy as a function of the mines encountered, and the vehicle's position referenced by the locating means; and destroying the mine according to the attack strategy communicated to the vehicle.

2. Method according to claim 1, wherein when a mine laid on a bed of a body of water is located by the hunter and after the step of releasing the locating means further comprising the steps of:

setting the vehicle in orbit around the locating means then, after transmission to the vehicle of the position parameters of the mine referenced by the locating means, using the tactical control station of the hunter; and setting the vehicle in orbit around the mine and, after having transmitted the attack strategy to the vehicle, in breaking the orbit around the mine in order to attack the mine from a position above the mine.

3. Method according to claim 2, characterized in that the mine is destroyed after the hunter has reached a determined safety distance from the mine.

4. Method according to claim 1, wherein when a tethered mine, is located by the hunter after the step of releasing the locating means at a determined distance from the mine, further comprising the steps of:

setting the vehicle in orbit around the mine at a depth determined by a locating and a displacement means of the vehicle; and breaking the orbit around the mine in order to attack the mine in motion from a side of the mine.

5. Method according to claim 3, characterized in that the mine is destroyed after the hunter has reached a determined safety distance from the mine.

6. Method according to any one of claims 1 to 3, wherein the mine is destroyed after the hunter has reached a determined safety distance from the mine.

7. System for destroying submerged mines, including a submerged, remotely guided vehicle carrying both underwater destruction devices and a locating means which is to be released by the vehicle in the vicinity of the mine comprising:

a classification sonar coupled to a tactical control station arranged on board a hunter wherein said sonar is for detecting and classifying the mine and the tactical control station is for guiding the vehicle and giving the vehicle parameters necessary for the vehicle to move as well as an attack strategy to be adopted in order to destroy the mine as a function of the mine encountered wherein the vehicle is consumable and includes transmission and reception means allowing the vehicle to communicate with the tactical control station of the hunter, a set of sensors, coupled to computation means integrated in the vehicle, for computing the trajectory to be adapted as a function of the parameters, continuously updated by the tactical control station, which relate to a position of the mine referenced by the locating means and are transmitted to the tactical control station by means of communication means provided in the vehicle.

8. System according to claim 7, characterized in that the vehicle further comprises:

propulsion means;

rudder means;

a compartment for carrying submarine munitions which is located at the centre of the vehicle; a set of homers and of sensors, coupled to internal means for computation and control of the propulsion and rudder means; and a marker which is located in the head of the vehicle and can be ejected using an ejection device.

9. System according to claim 7, wherein the locating means comprises:

an acoustic transmission transducer arranged on a float which also serves as an acoustic reflector, the float being coupled to an anchor which also serves as a transmitter, by means of a tether which serves as a conductor between the transmitter and the acoustic transmission transducer.

10. System according to claim 7, wherein the classifying sonar and the tactical control station are mounted on the hull of the hunter.

11. System according to claim 7, wherein the tactical control station includes a transmission/reception base with two hemispherical acoustic transducers.

* * * * *